US008418878B2

(12) United States Patent
Yoda et al.

(10) Patent No.: US 8,418,878 B2
(45) Date of Patent: Apr. 16, 2013

(54) PACKAGING CONTAINER

(75) Inventors: Kenji Yoda, Kanagawa (JP); Takanori Noda, Kanagawa (JP); Yasuo Shiina, Kanagawa (JP)

(73) Assignees: Sony Computer Entertainment Inc., Tokyo (JP); Nihon Houzai Co., Ltd., Tokyo (JP)

( * ) Notice: Subject to any disclaimer, the term of this patent is extended or adjusted under 35 U.S.C. 154(b) by 505 days.

(21) Appl. No.: 12/541,520

(22) Filed: Aug. 14, 2009

(65) Prior Publication Data

US 2010/0147852 A1 Jun. 17, 2010

(30) Foreign Application Priority Data

Dec. 16, 2008 (JP) ..... 2008-320269

(51) Int. Cl.
*B65D 51/20* (2006.01)
*B65D 17/34* (2006.01)
*B65D 17/40* (2006.01)

(52) U.S. Cl.
USPC ..... 220/789; 220/257.1; 220/257.2; 220/270; 220/276; 215/251

(58) Field of Classification Search ..... 215/251, 215/273, 302; 220/257.1, 257.2, 258.2, 270, 220/276, 359.2, 789
See application file for complete search history.

(56) References Cited

U.S. PATENT DOCUMENTS 3,552,634 A * 1/1971 Ollier et al. ..... 229/123.1
4,990,345 A * 2/1991 Webb ..... 426/123
5,007,231 A 4/1991 Ingemann
7,762,421 B2 * 7/2010 Fujimura ..... 220/359.1
2006/0289542 A1 * 12/2006 Schedl et al. ..... 220/359.2

FOREIGN PATENT DOCUMENTS

| | | | |
|---|---|---|---|
| JP | 57-004164 | U | 1/1982 |
| JP | 04-106255 | U | 9/1992 |
| JP | 6-003826 | U | 1/1994 |
| JP | 6-99970 | A | 4/1994 |
| JP | 2001097444 | A | 4/2001 |
| JP | 2002211647 | A | 7/2002 |
| JP | 2003231543 | A | 8/2003 |
| JP | 2005-212811 | A | 8/2005 |

OTHER PUBLICATIONS

Office Action for corresponding Japanese Patent Application No. 2008-320269, dated on Feb. 19, 2013.

* cited by examiner

*Primary Examiner* — Anthony Stashick
*Assistant Examiner* — Madison L Poos
(74) *Attorney, Agent, or Firm* — Matthew B. Dernier, Esq.; Gibson & Dernier LLP

(57) ABSTRACT

Provided is a packaging container that simplifies the opening operation. The packaging container includes a front cover member and a back cover member, which are attached to each other to form a housing space for accommodating an article therein. The back cover member is integrally molded from a sheet-shaped plastic. The back cover member includes an opening portion, which is surrounded by an opening assisting line portion formed in a linear form and opened by tearing the opening assisting line portion when the packaging container is opened. The back cover member is formed so that its surface is recessed at the opening assisting line portion.

6 Claims, 13 Drawing Sheets

PACKAGING CONTAINER

BACKGROUND OF THE INVENTION

1. Field of the Invention

The present invention relates to a packaging container for accommodating articles, and in particular, a technique of simplifying the task of opening the container.

2. Description of the Related Art

Conventionally, a packaging container including a cover member molded from a sheet-shaped plastic is used. For example, in the packaging container of JP 2001-97444 A, a pair of cover members (clamshell in JP 2001-97444 A), which construct a housing space for accommodating an article, are both molded from the sheet-shaped plastic. The outer peripheral portions of the cover members are then welded to seal the packaging container.

The packaging container of the related art, however, requires a troublesome operation when opened. For example, a job of cutting off the welded portion of the cover members from the packaging container using scissors and the like, and separating the two covers is required.

SUMMARY OF THE INVENTION

In view of the above-mentioned problems, it is an object of the present invention to provide a packaging container that simplifies the opening operation.

In order to achieve the above-mentioned object, according to the present invention, there is provided a packaging container including a pair of cover members attached to each other to form a housing space for accommodating an article therein, in which: at least one of the pair of cover members is integrally molded from a sheet-shaped plastic; the at least one of the pair of cover members includes an opening portion at one part thereof facing the housing space, the opening portion being surrounded by an opening assisting line portion formed in a linear form, and being opened by tearing the opening assisting line portion when the packaging container is opened; and the at least one of the pair of cover members is formed so that a surface thereof is recessed at the opening assisting line portion.

According to the present invention, one of the cover members is formed so that the surface thereof is recessed at the opening assisting line portion, and hence the opening assisting line portion easily tears, and the opening operation is facilitated. The surface of the one of the cover members may be an inner surface of the one of the cover members facing the other of the cover members, or may be an outer surface of the surface on the opposite side of the inner surface.

In one aspect of the present invention, the opening assisting line portion may include a recessed portion for recessing the surface of the at least one of the pair of cover members. According to this aspect, the force required for opening can be adjusted by adjusting the depth of the recessed portion.

In this aspect, the opening assisting line portion may include a plurality of the recessed portions lined in an extending direction of the opening assisting line portion. The recessed portion may present a groove extending in the extending direction of the opening assisting line portion. The opening assisting line portion may include a plurality of holes passing through the at least one of the pair of cover members and recessing the surface of the at least one of the pair of cover members, and the plurality of the recessed portions and the plurality of holes may be lined up in the extending direction of the opening assisting line portion so as to coexist on the opening assisting line portion. With these structures, the opening assisting line portion can be more easily torn, and the opening operation can be further simplified. An interval between adjacent two of the plurality of the recessed portions may be smaller than a thickness of the at least one of the pair of cover members. With this structure, the opening portion can be smoothly opened by closely arranging the plurality of the recessed portions.

Further, in another aspect of the present invention, the at least one of the pair of cover members may be formed with an opening, and the opening assisting line portion may extend from an edge of the opening and surrounds the opening portion. According to this aspect, the worker performing the opening operation can pick the opening portion by putting a finger or the like in the opening, and pulling the opening portion to tear the opening assisting line portion.

In this aspect, the opening assisting line portion may include a slit formed at an end thereof, and the slit may continue to the opening. The opening assisting line portion is thus more easily torn, and the opening operation can be further simplified.

Further, in another aspect of the present invention, the packaging container may include a panel that can be curved, and the panel is arranged along the opening portion at an inner side of the packaging container. The panel may be arranged so that an outer peripheral edge thereof extends along the opening assisting line portion, and may be larger than the opening portion. According to this aspect, the outer peripheral edge of the panel is hooked to the edge of the opening that is formed in the cover member when the opening portion is opened, and thus the article is prevented from being dropped from the packaging container just after the opening portion is opened.

DETAILED DESCRIPTION OF THE INVENTION

Figure 1:
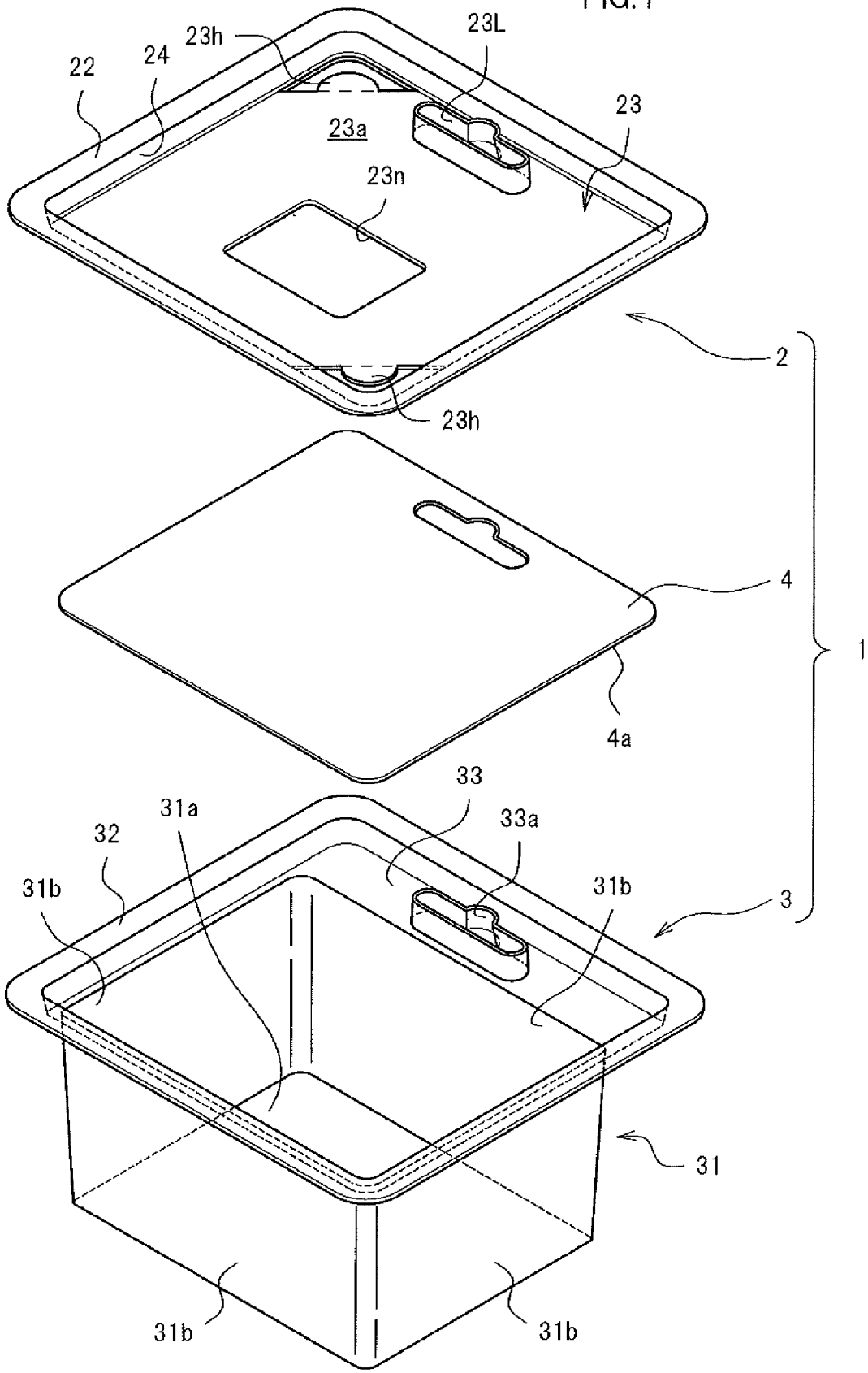
FIG. 1 is an exploded perspective view of a packaging container serving as an example according to an embodiment of the present invention.
Figure 2:
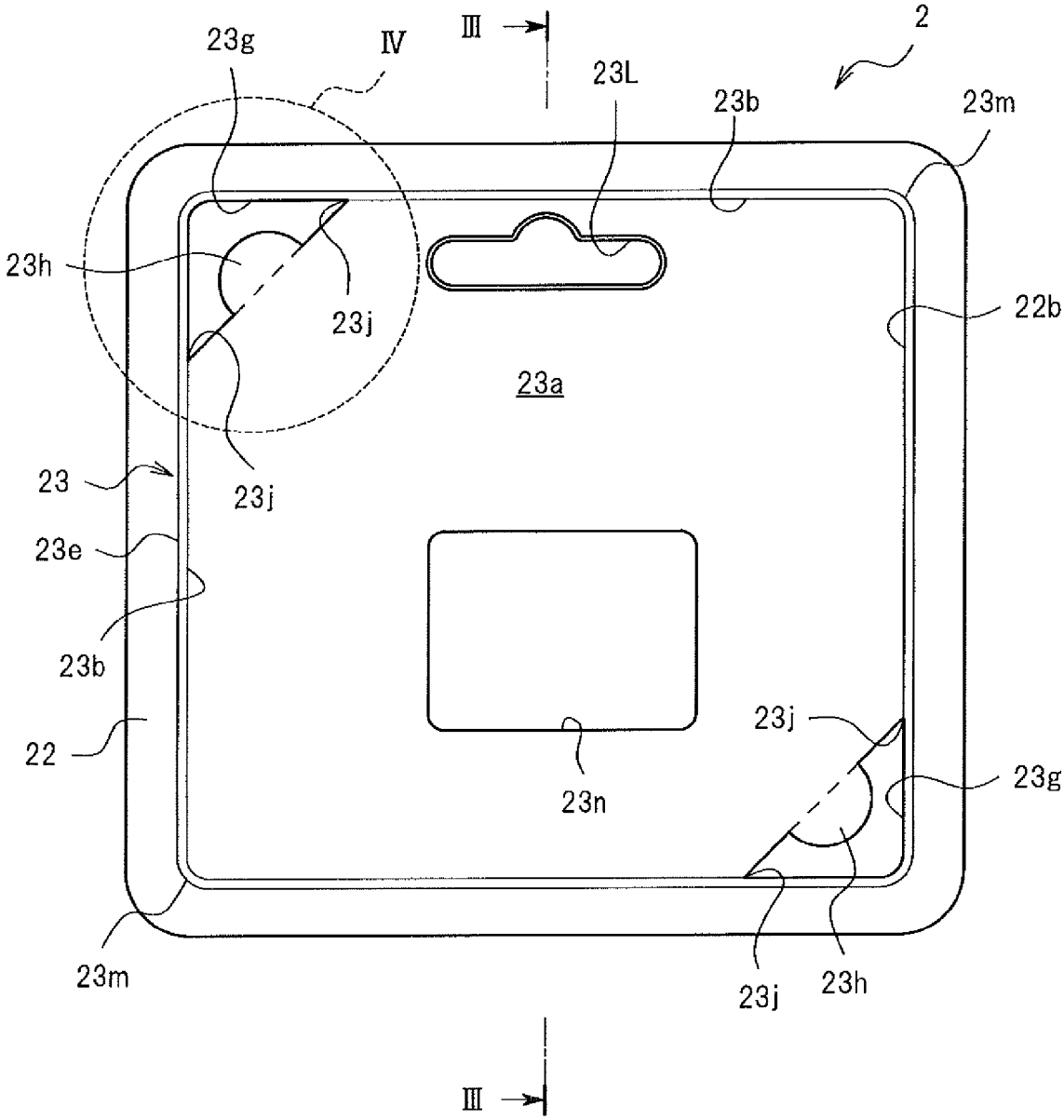
FIG. 2 is a view of a back cover member of the packaging container seen from the exterior of the packaging container.
Figure 3:
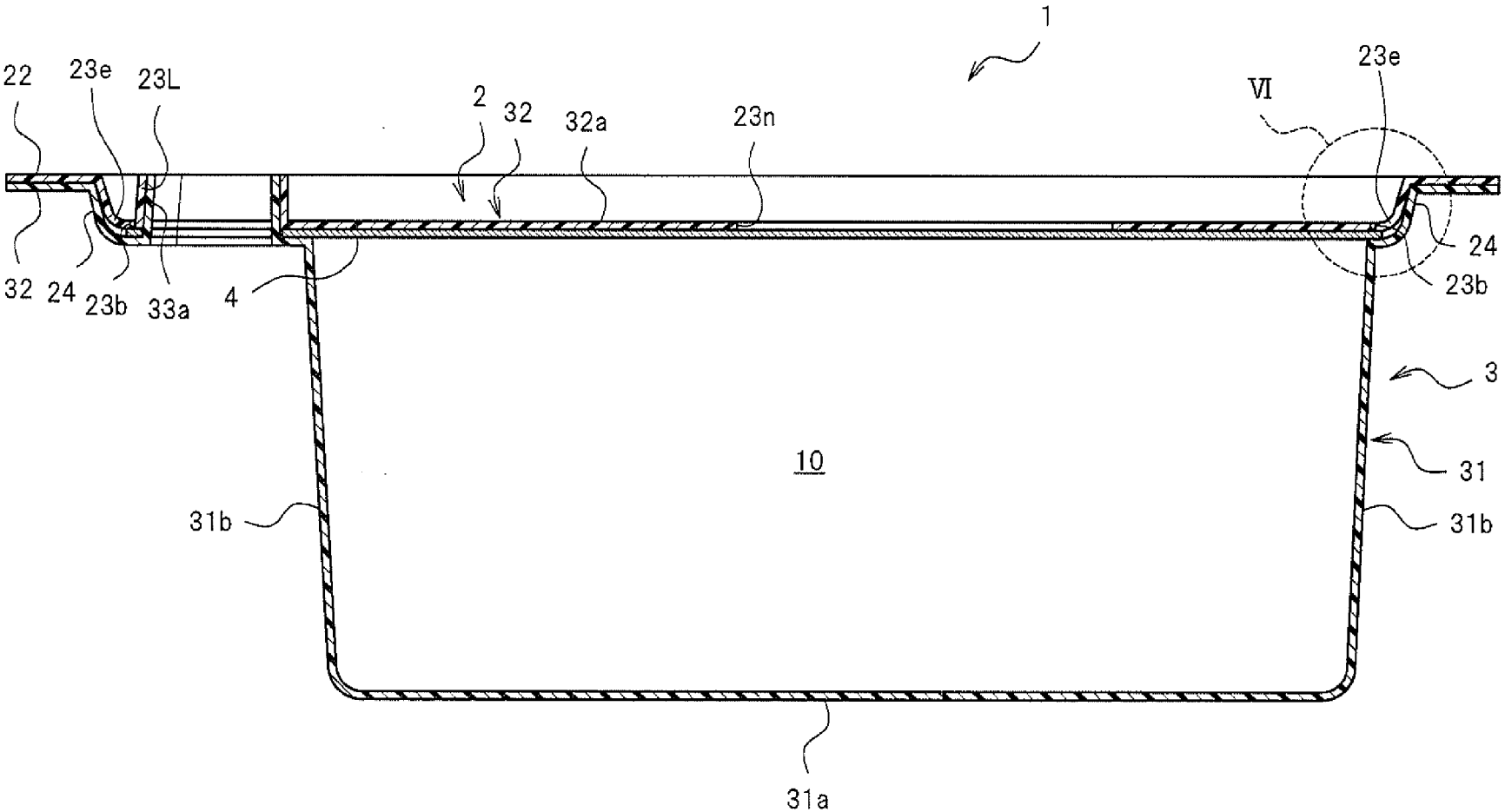
FIG. 3 is a cross-sectional view taken along a line III-III illustrated in FIG. 2, where a front cover member of the packaging container is illustrated in addition to the back cover member.
Figure 4:
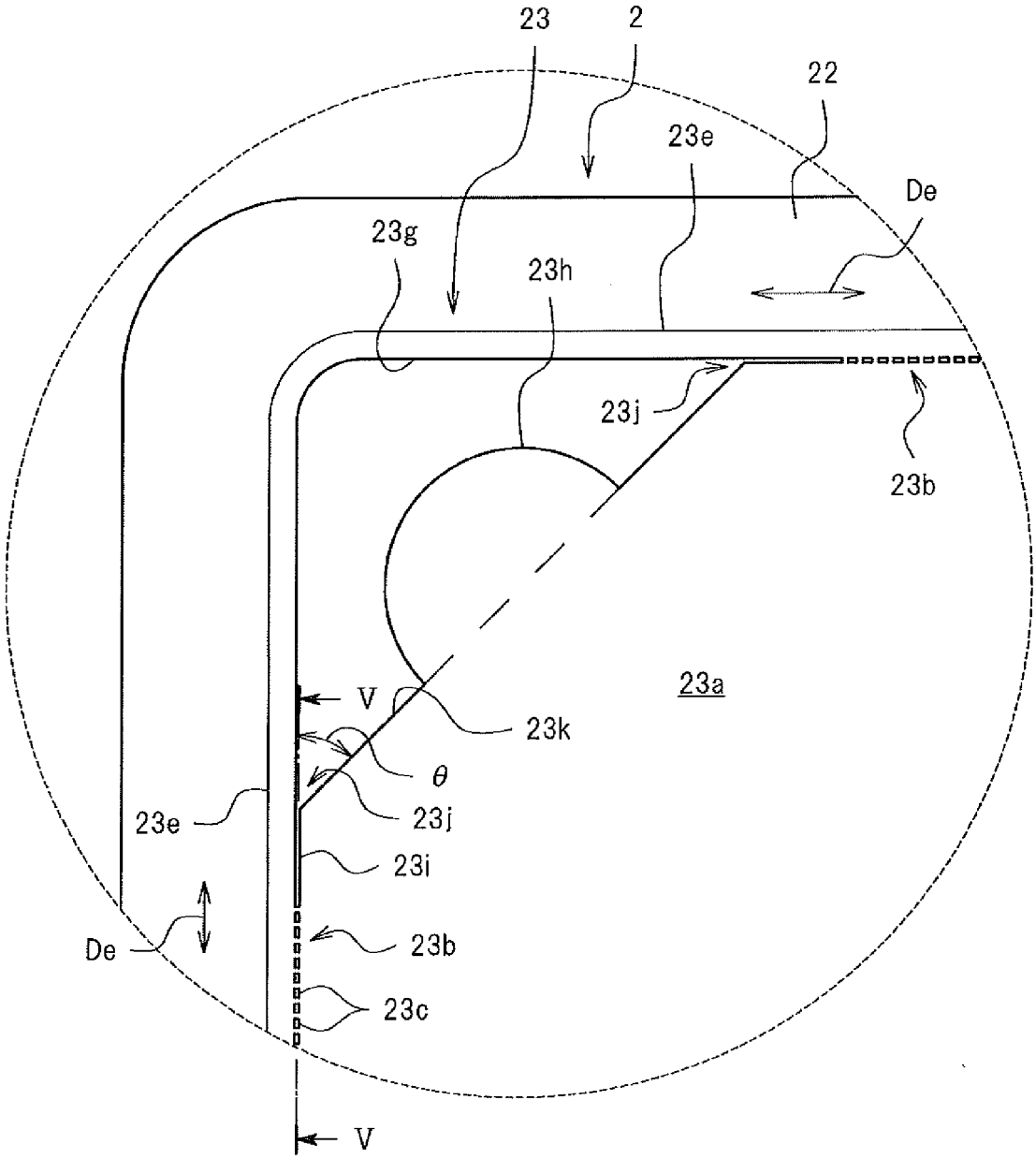
FIG. 4 is an enlarged view of a portion surrounded by a broken line IV illustrated in FIG. 2.
Figure 5:
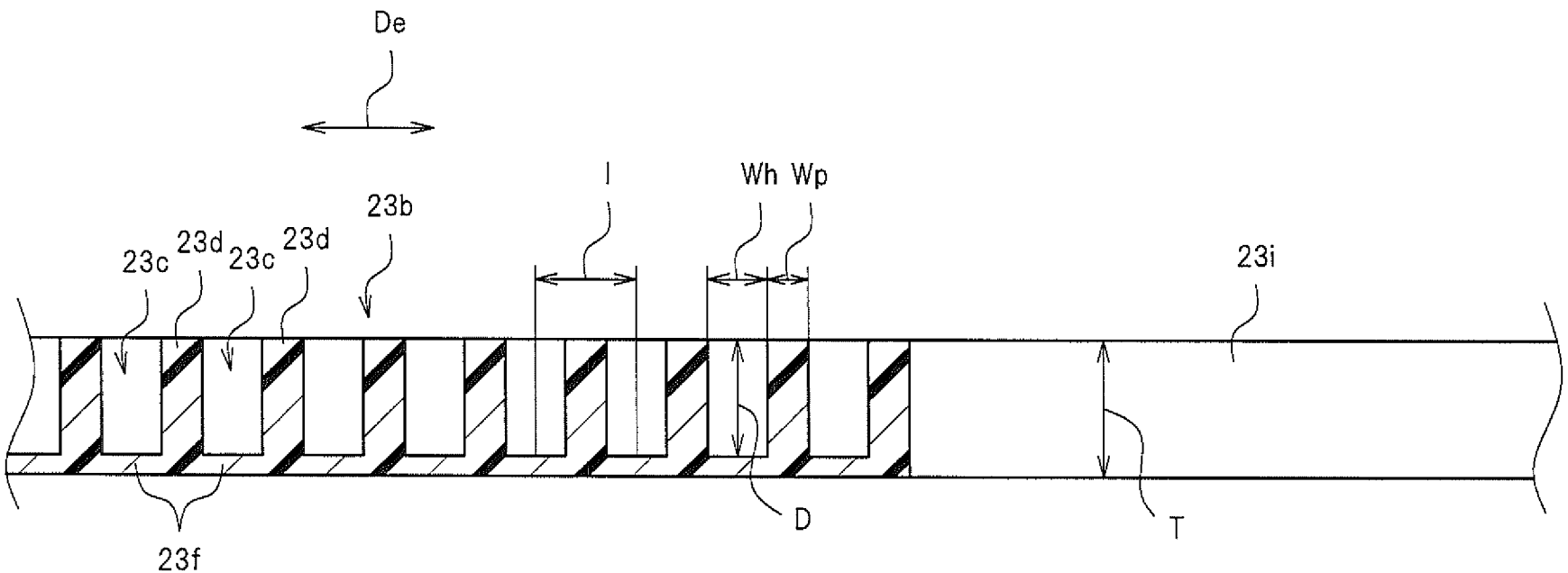
FIG. 5 is a cross-sectional view taken along a line V-V illustrated in FIG. 4.
Figure 6:
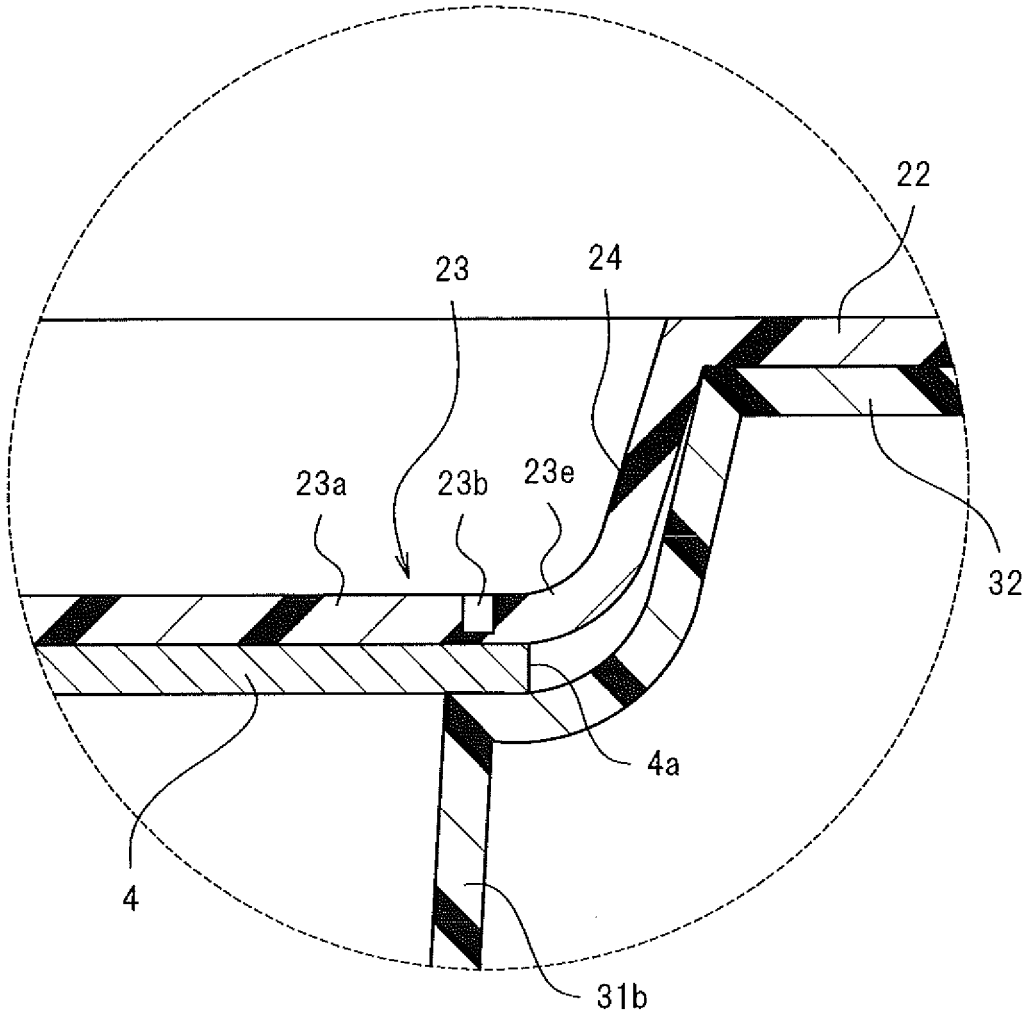
FIG. 6 is an enlarged view of a portion surrounded by a broken line VI illustrated in FIG. 3.

One embodiment of the present invention is described hereinbelow with reference to the drawings. FIG. 1 is an exploded perspective view of a packaging container 1 serving as an example of the embodiment of the present invention. FIG. 2 is a view of a back cover member 2 of the packaging container 1 seen from the exterior of the packaging container 1, and FIG. 3 is a cross-sectional view taken along a line III-III illustrated in FIG. 2. In FIG. 3, a front cover member 3 of the packaging container 1 is illustrated in addition to the back cover member 2. FIG. 4 is an enlarged view of a portion surrounded by a broken line IV illustrated in FIG. 2, and FIG. 5 is a cross-sectional view taken along a line V-V illustrated in FIG. 4. FIG. 6 is an enlarged view of a portion surrounded by a broken line VI illustrated in FIG. 3.

As illustrated in FIG. 1, the packaging container 1 includes the back cover member 2 and the front cover member 3. The back cover member 2 and the front cover member 3 are attached to each other thereby forming a housing space 10, in which articles can be accommodated, on the inner side of these cover members (see FIG. 3). The housing space 10 accommodates an electronic device, and accessories of the electronic device. The packaging container 1 is a so-called blister pack. In this example, each of the back cover member 2 and the front cover member 3 are integrally molded from a sheet-shaped plastic (e.g., thermoplastic resin such as a polystyrene resin, a vinyl chloride series resin, a polypropylene resin, a polyethylene resin, an acrylic resin, or a polyethylene terephthalate resin). The back cover member 2 and the front cover member 3 are molded with a transparent plastic and the like so that the articles accommodated in the housing space 10 can be seen from the outside. The back cover member 2 and the front cover member 3 may be molded from different materials.

The front cover member 3 has a square frame-shaped flange 32 on an outer peripheral edge thereof, and the flange 32 faces the back cover member 2. A section on the inner side of the flange 32 is recessed, and an accommodation recessed section 31, which is the recessed section of a size capable of accommodating the articles to be accommodated in the housing space 10, is formed on the inner side of the flange 32. In this example, the accommodation recessed section 31 has a substantially square front wall portion 31*a* positioned at the bottom of the accommodation recessed section 31. The accommodation recessed section 31 is formed of the front wall portion 31*a*, and four side wall portions 31*b* respectively upright at the four edges of the front wall portion 31*a*. The packaging container 1 is placed at the time of use (e.g., when displaying a plurality of packaging containers 1 accommodating articles) so that the front wall portion 31*a* is the front. A facing section 33 that faces the back cover member 2 is formed spreading from an upper edge of one of the side wall portions 31*b* at the inner side of the flange 32. The facing section 33 is provided with a hole 33*a*, where a hook or the like for hanging the packaging container 1 is passed through the hole 33*a* when the packaging container 1 is used.

As illustrated in FIG. 3, the back cover member 2 is attached to the front cover member 3 so as to close the accommodation recessed section 31 of the front cover member 3, thereby forming the housing space 10 on the inner side of the accommodation recessed section 31 together with the front cover member 3. Specifically, the back cover member 2 is formed in a substantially plate-shape, and a square frame-shaped flange 22 that faces the flange 32 of the front cover member 3 is provided on an outer peripheral edge of the back cover member 2 (see FIG. 2). The flange 22 is attached to the flange 32 by, for example, thermal welding or adhesive. The flange 22 may also be attached to the flange 32 by a fastener such as a stapler.

A portion on the inner side of the flange 22 of the back cover member 2 is slightly recessed towards the front cover member 3, and therefore an inner wall section 24 dropping from the inner edge of the flange 22 and a plate-shaped back wall section 23 surrounded by the inner wall section 24 are formed on the inner side of the flange 22 (see FIG. 1). When the flange 22 is attached to the flange 32, the inner wall section 24 put into the inner side of the flange 32 and the back wall section 23 closes the accommodation recessed section 31 (see FIG. 3). A hole 23L is formed in the back wall section 23 at a position corresponding to the hole 33*a*. The hook or the like for hanging the packaging container 1 is passed through both the hole 33*a* and the hole 23L when the packaging container 1 is used.

As illustrated in FIG. 2 or FIG. 4, the back wall section 23 is provided with a linear opening assisting line portion 23*b*. The back wall section 23 is formed such that a surface thereof is recessed at the opening assisting line portion 23*b*, whereby the strength of the back cover member 2 at the opening assisting line portion 23*b* is lower than the strength of other portions of the back cover member 2. The back wall section 23 is also provided with a plate-shaped opening portion 23*a* surrounded by the opening assisting line portion 23*b*. That is, the opening assisting line portion 23*b* is formed at the outer peripheral edge of the opening portion 23*a*. In opening the packaging container 1, the opening portion 23*a* is opened by tearing the opening assisting line portion 23*b*. For example, when a worker pulls part of the opening portion 23*a* (for example, a pick-up portion 23*h* to be hereinafter described) to the outer side of the packaging container 1 to tear the back wall section 23 at the opening assisting line portion 23*b*, the opening portion 23*a* is opened. The opening portion 23*a* faces the housing space 10 (see FIG. 3), whereby the article placed in the housing space 10 can be taken out from an opening which becomes formed at the back wall section 23 by opening the opening portion 23*a*.

As illustrated in FIG. 5, a recessed portion 23*c* for recessing the surface of the back wall section 23 is formed at the opening assisting line portion 23*b*. The recessed portion 23*c* does not pass through the back wall section 23, and a bottom portion 23*f* configuring the bottom of the recessed portion 23*c* is provided at the recessed portion 23*c*. In this example, the opening assisting line portion 23*b* is formed with a plurality of recessed portions 23*c* lined up in an extending direction (direction indicated by De in FIG. 4 or FIG. 5) of the opening assisting line portion 23*b*, and a bottom portion 23*f* is provided at each recessed portion 23*c*. The plurality of recessed portions 23*c* are formed in a dotted line (perforated line) which surrounds the opening portion 23*a*. A partitioning portion 23*d* for partitioning the two adjacent recessed portions 23*c* discontinuously connects the inner side of the opening assisting line portion 23*b*, that is, the opening portion 23*a* and the outer side (outer peripheral edge 23*e* side of the back wall section 23 (see FIG. 6)).

In this example, the recessed portion 23*c* is formed at the outer surface of the back cover member 2 (surface on the side opposite to the housing space 10), and each recessed portion 23*c* is opened towards the outer side of the packaging container 1 (side opposite to the housing space 10). The bottom portion 23*f* is provided on the inner surface side of the back cover member 2 (housing space 10 side), and is positioned on the side opposite to the direction in which the opening portion 23*a* is opened. Thus, the inner side of the opening assisting line portion 23*b* (i.e., opening portion 23*a*) and the outer side (outer peripheral edge 23*e* side) are continuously connected to each other by way of the opening assisting line portion 23*b* at the inner surface side of the back cover member 2. In opening the packaging container 1, the partitioning portion 23*d* and the bottom portion 23*f* are sequentially cut, thereby opening the opening portion 23*a*.

A width Wh of the recessed portion 23*c* in the extending direction of the opening assisting line portion 23*b* and a width Wp of the partitioning portion 23*d* are smaller than a thickness T of the back cover member 2. In particular, in this example, an interval I of the two adjacent recessed portions 23*c* is also smaller than the thickness T of the back cover member 2. Moreover, in this example, the width Wh of the recessed portion 23*c* is greater than the width Wp of the partitioning portion 23*d*. Also a depth D of the recessed portion 23*c* exceeds a depth of half of the thickness T.

For example, the thickness T of the back cover member 2 molded from a sheet-shaped plastic is between about 0.5 mm and 1.0 mm, and the width Wp of the partitioning section 23*d* is between about 0.15 mm and 0.3 mm. The depth D of the recessed portion 23*c* is between about 0.3 mm and 0.5 mm. In FIG. 4 and FIG. 6, an enlarged recessed portion 23*c* is illustrated for clarification.

The opening assisting line portion 23*b* can be molded by a comb-shaped die having at an end edge thereof a plurality of projections of shapes corresponding to the recessed portions 23*c*. In other words, the opening assisting line portion 23*b* can be molded by pressing the comb-shaped die against the sheet-shaped plastic, which is the base of the back cover member 2, during manufacturing of the back cover member 2. The comb-shaped die is formed by performing laser processing and the like on the edge of a thin plate-shaped metal and removing the metal between the adjacent projections.

As illustrated in FIG. 2, the opening assisting line portion 23*b* extends along the outer peripheral edge 23*e* of the back wall section 23. In this example, the back wall section 23 has a substantially square shape, and the opening assisting line portion 23*b* is formed in a square frame form. Also, the opening assisting line portion 23*b* is close to the outer peripheral edge 23*e*, and therefore the opening portion 23*a* forms the major portion of the back wall section 23. Thus, a large opening becomes formed in the back cover member 2 by opening the opening portion 23*a*, and the article can be easily taken out from the housing space 10. In addition, the opening assisting line portion 23*b* may be arranged at the outer peripheral edge 23*e* of the back wall section 23. In this case, the entire back wall section 23 can be opened by tearing the opening assisting line portion 23*b*. Furthermore, the packaging container 1 described herein includes a panel 4 placed between the back cover member 2 and the front cover member 3. Thus, the worker first takes out the panel 4 from the opening formed in the back wall section 23 by opening the opening portion 23*a*, and thereafter can take out the article from the housing space 10. The panel 4 will be described later.

In this example, the opening assisting line portion 23*b* is formed to surround the entire periphery of the opening portion 23*a*, and hence the opening portion 23*a* is cut off from the back cover member 2 by tearing the opening assisting line portion 23*b*, and the portion of the back cover member 2 on the outer side of the opening assisting line portion 23*b* remains with the packaging container 1. In addition, the opening assisting line portion 23*b* may be formed without surrounding the entire periphery of the opening portion 23*a* so that a part of the opening portion 23*a* remains in contact with the back cover member 2 even after the opening portion 23*a* is opened.

In the packaging container 1, the opening assisting line portion 23*b* and the opening portion 23*a* surrounded by the opening assisting line portion 23*b* are formed on the back cover member 2 on which external force is less likely to act compared to the front cover member 3 when, for example, the packaging container 1 is transported. Thus, the opening assisting line portion 23*b* is prevented from being mistakenly torn when the packaging container 1 is transported, thereby suppressing the opening of the opening portion 23*a*.

As illustrated in FIG. 2 or FIG. 4, the back wall section 23 is provided with a plurality of (two in this example) openings 23*g* smaller than the article to be accommodated in the housing space 10, that is, smaller than the opening that becomes formed at the back wall section 23 when the opening portion 23*a* is opened. In this example, the opening 23*g* of substantially triangular shape is formed at two corners of the four corners of the square back wall section 23, and the two corners are positioned on a diagonal line of the back wall section 23. The pick-up portion 23*h* is provided at the opening portion 23*a*. The pick-up portion 23*h* projects out towards the center of the opening 23*g* from an edge 23*k* of the opening portion 23*a* bordering the opening 23*g*. Thus, the worker can open the opening portion 23*a* by prizing the pick-up portion 23*h* toward the outer side of the packaging container 1 (i.e., tilting the pick-up portion 23*h* upward), and pulling the pick-up portion 23*h* towards the outer side. The pick-up portion 23*h* may be tilted upward in advance with respect to the opening portion 23*a*.

The opening assisting line portion 23*b* extends from two positions on the edge of the opening 23*g*, and the two positions are spaced apart from each other. In this example, as described above, the opening 23*g* is formed in a substantially triangular shape, and has two corners 23*j* at an inner edge thereof. The opening assisting line portion 23*b* extends from the two corners 23*j* of one opening 23*g* to the corners 23*j* of the other opening 23*g* so as to surround the opening portion 23*a*.

As illustrated in FIG. 4 or FIG. 5, a slit 23*i* which is long in the extending direction of the opening assisting line portion 23*b* and passes through the back cover member 2 in the thickness direction thereof is formed at the end of the opening assisting line portion 23*b*. The slit 23*i* continues to the opening 23*g*. In this example, an angle θ formed by the extending direction of the opening assisting line portion 23*b* and the edge of the opening 23*g*, that is, the edge 23*k* bordering the opening 23*g* of the outer peripheral edge of the opening portion 23*a*, is set to about 45 degrees (see FIG. 4).

As illustrated in FIG. 1 or FIG. 3, the packaging container 1 includes the rectangular panel 4 configured as a separate member from the back cover member 2 and the front cover member 3. That is, the panel 4 is not attached to the back cover member 2 and the front cover member 3 with adhesive or the like, and can be separated from the back cover member 2 and the front cover member 3. The panel 4 is placed along the opening portion 23*a* between the back cover member 2 and the front cover member (see FIG. 3). Thus, when the packaging container 1 is opened, the panel 4 first appears from the opening formed in the back wall section 23 by opening the opening portion 23*a*. In this example, the panel 4 is placed so as to close the opening 23*g* from the inner side of the packaging container 1. In addition, as illustrated in FIG. 1, a rectangular opening 23*n* is also formed at the center of the opening portion 23*a*. The panel 4 also blocks the opening 23*n* from the inner side.

As illustrated in FIG. 6, the panel 4 is placed such that an outer peripheral edge 4*a* thereof extends along the opening assisting line portion 23*b*, and is larger than the opening portion 23*a*. Thus, the outer peripheral edge 4*a* of the panel 4 is positioned closer to the outer peripheral edge 23*e* of the back wall section 23 than the opening assisting line portion 23*b*, and the outer peripheral edge 4*a* of the panel 4 is caught by the edge of the opening formed in the back wall section 23 when the opening portion 23*a* is opened. Thus, even if the opened packaging container 1 is placed such that the back cover member 2 is positioned below the front cover member 3, the panel 4 prevents the articles in the housing space 10 from dropping.

The panel 4 is made of a bendable material that can be curved (e.g., cardboard). Thus, the worker pushes and widens the flanges 22 and 32 of the back cover member 2 and the front cover member 3 and curves the panel 4 after opening the packaging container 1, and can thereby take out the panel 4 from the opening formed at the back wall section 23. The articles then can be taken out from the housing space 10.

As described above, the packaging container 1 include the back cover member 2 and the front cover member 3 attached to each other to form the housing space 10 that can accommodate an article therein. The back cover member 2 is integrally molded from a sheet-shaped plastic. The back cover member 2 includes the opening portion 23*a* at one part thereof facing the housing space 10, and the opening portion 23*a* is surrounded by the linearly formed opening assisting line portion 23*b* and is opened by tearing the opening assisting line portion 23*b* when the packaging container 1 is opened. The back cover member 2 has the surface (outer surface of the back cover member 2 in this example) formed so as to be recessed at the opening assisting line portion 23*b*. According to such a packaging container 1, the opening assisting line portion 23*b* is easy to tear, and the opening operation of the packaging container 1 is simplified.

In the packaging container 1, the recessed portions 23*c* extend along the opening assisting line portion 23*b*, and the surface of the back cover member 2 is recessed at the recessed portions 23*c*. Thus, the depth of the recessed portion 23*c* can be adjusted and the ease of tearing the opening assisting line portion 23*b* can be adjusted in view of a worker who handles the packaging container 1 or the condition of the packaging container 1 during transportation. For example, even if the packaging container 1 is transported in a state in which external force is likely to act thereon, the packaging container 1 is prevented from being mistakenly opened by forming the depth of the recessed portion 23*c* to be shallow.

The present invention is not limited to the packaging container 1 described above, and various modifications can be made. For example, in the above description, the recessed portion 23*c* is formed at the outer surface of the back cover member 2, and the recessed portion 23*c* is opened towards the outer side of the housing space 10. However, the recessed portion 23*c* may be formed at the inner surface of the back cover member 2. In such a manner, when the recessed portion 23*c* is formed at the inner surface of the back cover member 2, the force of the worker acts in order on the partitioning portions 23*d* that are not yet cut when the worker pulls the opening portion 23*a* to the outer side of the packaging container 1, compared to when the recessed portion 23*c* is formed at the outer surface of the back cover member 2, thus simplifying the opening operation.

Figure 7A:
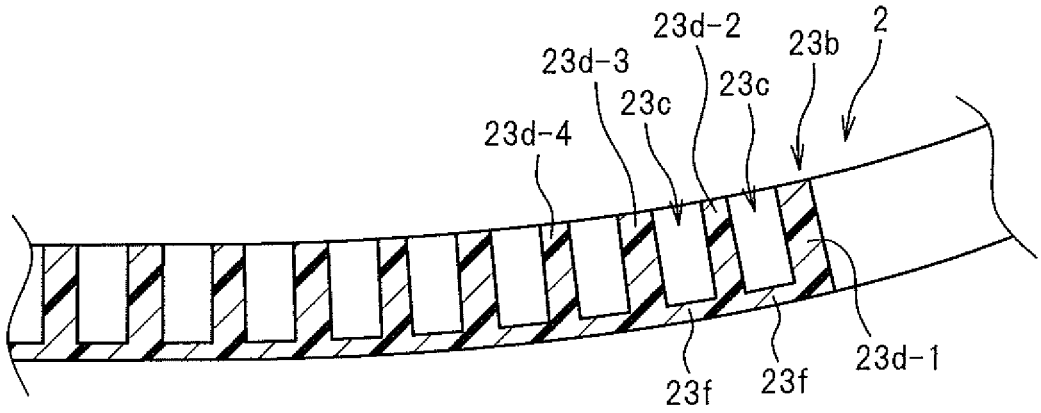
FIGS. 7A and B are views describing a force that acts on a partitioning portion when a worker pulls an opening portion to an outer side, where in FIG. 7A, a recessed portion is formed at an outer surface of the back cover member, similar to FIG. 5, and in FIG. 7B, the recessed portion is formed at an inner surface of the back cover member.
Figure 7B:
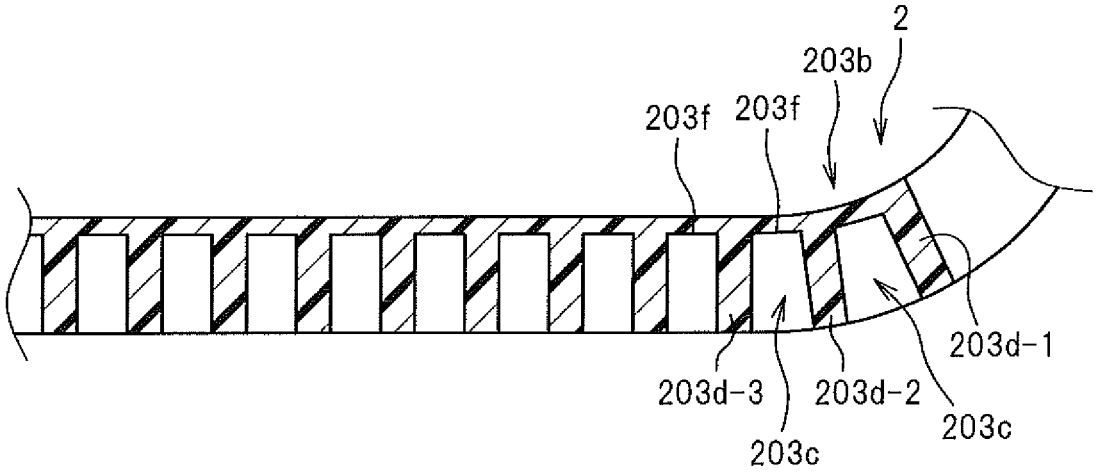

FIGS. 7A and 7B are views describing the force that acts on the partitioning portion when the worker pulls the opening portion 23*a* to the outer side. Similar to FIG. 5, the recessed portion 23*c* is formed at the outer surface of the back cover member 2 at the opening assisting line portion 23*b* illustrated in FIG. 7A. At an opening assisting line portion 203*b* illustrated in FIG. 7B, a recessed portion 203*c* is formed at the inner surface of the back cover member 2, and a bottom portion 203*f* is provided at the outer surface side of the back cover member 2. As illustrated in FIGS. 7A and 7B, the opening assisting line portions 23*b* and 203*b* are curved when the worker pulls the opening portion 23*a* to the outer side of the packaging container 1 (upper side in FIGS. 7A and 7B), and therefore the inner surface is strongly pulled compared to the outer surface of the back cover member 2. The bottom portion 23*f* and the lower part of the partitioning portion 23*d* are connected at the inner surface of the back cover member 2 illustrated in FIG. 7A. Thus, the force that acts on the inner surface of the back cover member 2 lifts up not only the partitioning portion 23*d*-1 immediately before being cut but also collectively lifts up a plurality of partitioning portions 23*d*-2, 23*d*-3, . . . continuing to the partitioning portion 23*d*-1, whereby the force of the worker is dispersed to the plurality of partitioning portions 23*d*-1, 23*d*-2, . . . . On the other hand, only the partitioning portion 203*d* is discontinuously formed at the inner surface of the back cover member 2 illustrated in FIG. 7B, and thus the force that acts on the inner surface of the back cover member 2 easily concentrates at the partitioning portion 203*d*-1 immediately before being cut. Thus, the opening assisting line portion easily tears when the recessed portion 203*c* is formed at the inner surface of the back cover member 2, compared to when the recessed portion 23*c* is formed at the outer surface of the back cover member 2. The recessed portion is desirably formed at the outer surface of the back cover member 2, as illustrated in FIG. 5, when the opening assisting line portion needs to be prevented from tearing with an excessively small force.

In the above-described description, for example, a plurality of the recessed portions 23*c* are formed in a dotted line form on the opening assisting line portion 23*b*. However, a groove-shaped recessed portion extending in the extending direction of the opening assisting line portion 23*b* may be formed on the opening assisting line portion 23*b*.

Figure 8:
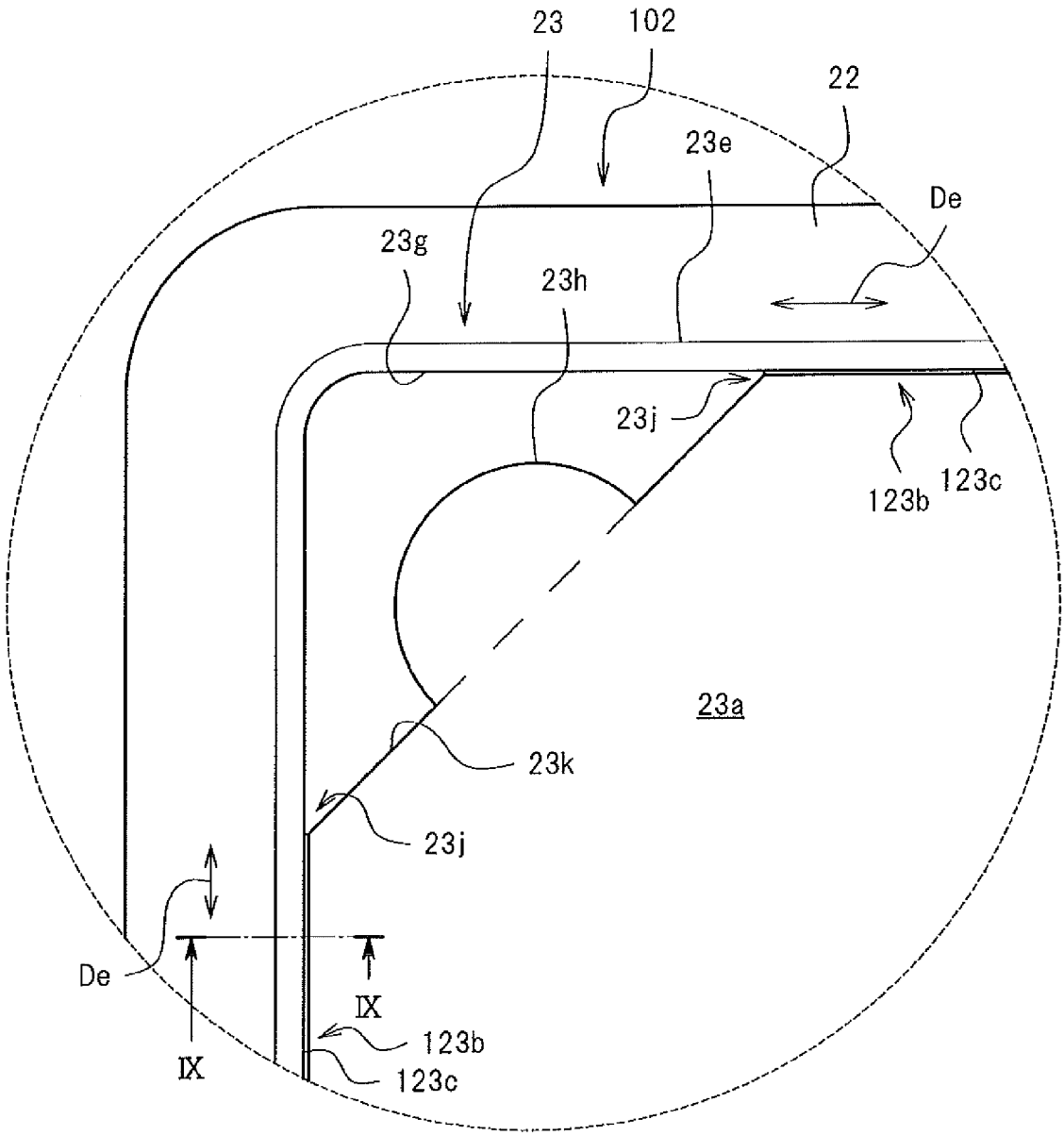
FIG. 8 is an enlarged view of a back cover member of a packaging container according to another embodiment of the present invention, in which a portion corresponding to the portion illustrated in FIG. 4 is illustrated in an enlarged manner.
Figure 9:
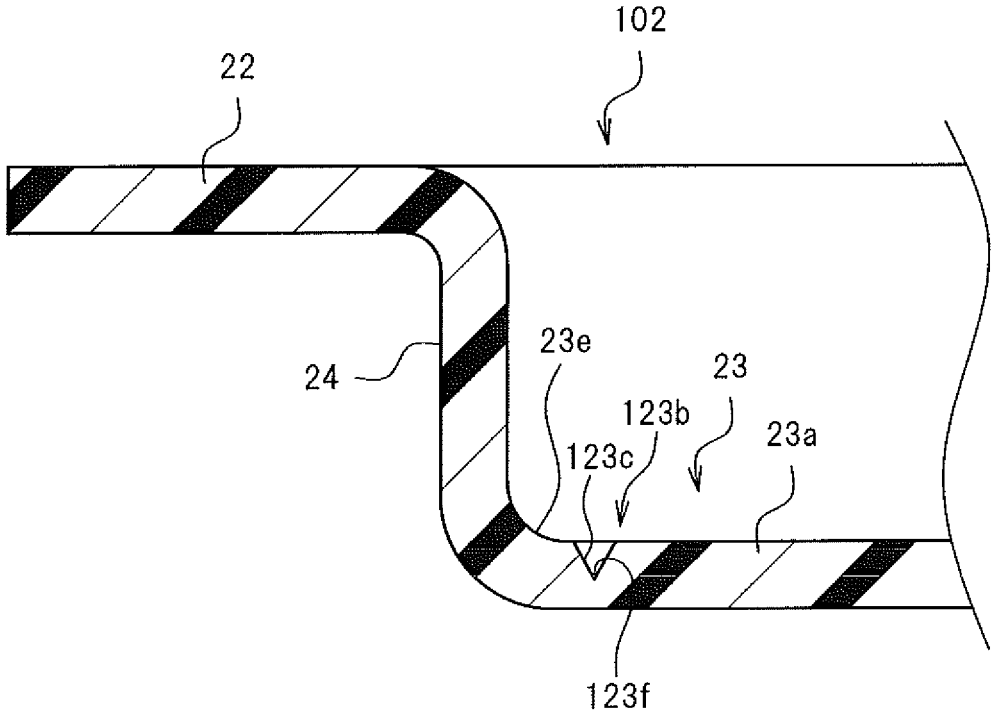
FIG. 9 is a cross-sectional view taken along a line IX-IX illustrated in FIG. 8.

FIG. 8 is an enlarged view of a back cover member 102 of a packaging container according to such an embodiment of the present invention, in which a portion corresponding to the portion illustrated in FIG. 4 is illustrated in an enlarged manner. FIG. 9 is a cross-sectional view taken along a line IX-IX illustrated in FIG. 8. In FIGS. 8 and 9, the same reference symbols are denoted for the same locations as the locations described above, and the description thereof is omitted.

As illustrated in FIG. 8 and FIG. 9, the back cover member 102 is provided with the opening portion 23*a*, similar to the back cover member 2. The opening portion 23*a* is surrounded by an opening assisting line portion 123*b*. A linearly extending recessed portion 123*c* of a groove-form is formed on the opening assisting line portion 123*b*, and a bottom portion 123*f* configuring the bottom of the groove is provided in the recessed portion 123*c*. The recessed portion 123*c* extends on the opening assisting line portion 123*b*, and surrounds the opening portion 23*a*. For example, if the two openings 23*g* are formed in the back cover member 102, similar to the back cover member 2, the recessed portion 123*c* is formed to extend from the two corners 23*j* of one of the openings 23*g* to the corners 23*j* of the other opening 23*g*. In addition, a slit which is long in the extending direction of the opening assisting line portion 123*b* and passes through the back cover member 102 may be formed in the middle of the opening assisting line portion 123*b*.

Figure 10:
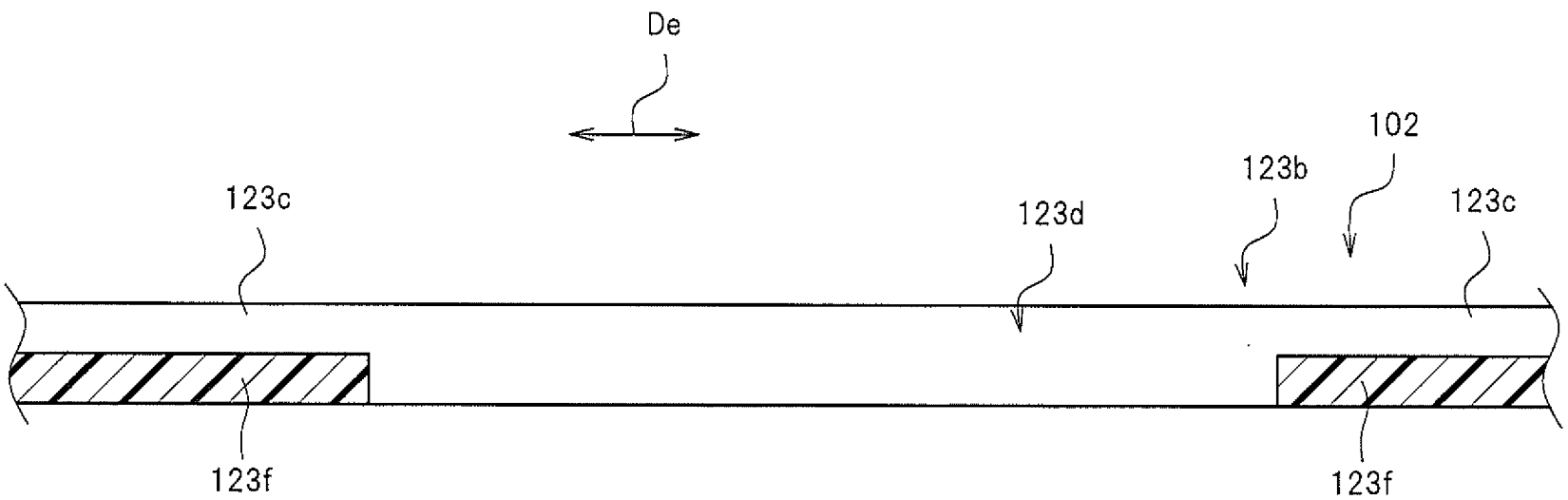
FIG. 10 is a cross-sectional view illustrating a slit formed in the back cover member illustrated in FIG. 8, and illustrates a state in which the back cover member is cut along an opening assisting line portion.

FIG. 10 is a cross-sectional view of the back cover member 102 for illustrating the slit as described above, and illustrates a state in which the back cover member 102 is cut along the opening assisting line portion 123*b*. A slit 123*d* passing through the back cover member 102 is formed in the opening assisting line portion 123*b* illustrated FIG. 10. Also, the slit 123*d* is positioned in the middle of the groove-shaped recessed portion 123*c*. For example, the slit 123*d* is formed at the outer peripheral edge of the corner of the opening portion 23*a*. For example, if the two openings 23*g* are formed on the diagonal line of the back wall section 23 as illustrated in FIG. 2, the slit 123*d* is formed along two corners 23*m* which are not provided with such an opening 23*g*. By providing the slit 123*d* at that position, the tearing of the opening assisting line portion 123*b* can be prevented from stopping at the corner of the opening portion 23*a* when the packaging container 1 is opened, and the opening operation of the packaging container 1 can be facilitated. In addition, the slit 123*d* may be formed on a linear portion provided in the opening assisting line portion 123*b*. Furthermore the slit 123*d* as described above may be discontinuously provided on the opening assisting line portion 123*b*.

The recessed portions 23*c* formed on the opening assisting line portion 23*b* described above do not pass through the back cover member 2, and the bottom portion 23*f* is provided in each recessed portion 23*c*. However, a plurality of holes (hereinafter referred to as through-holes) that pass through the back cover member 2 may be formed on the opening assisting line portion 23*b* so as to be aligned in the extending direction of the opening assisting line portion 23*b*, and the through-holes may recess the surface of the back cover member 2. In this case, a plurality of through-holes are formed in a dotted line shape on the opening assisting line portion 23*b*, and an interval between two adjacent through-holes is desirably smaller than the thickness of the back cover member 2, similar to the interval I of the recessed portion 23*c*. The through-holes may be formed at the end of the opening assisting line portion 23*b* (portion close to the opening 23*g*), and the recessed portions 23*c* maybe formed at other portions of the opening assisting line portion 23*b*.

Figure 11:
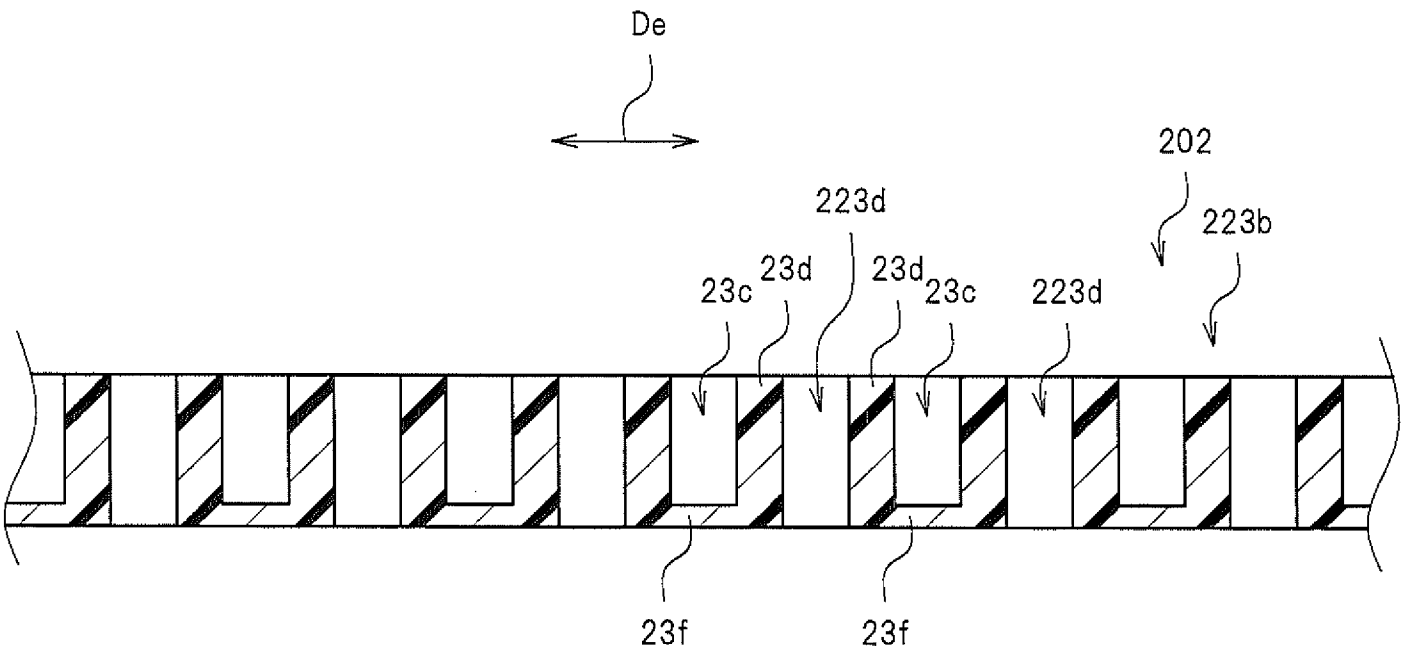
FIG. 11 is a cross-sectional view of a back cover member according to another embodiment of the present invention, and illustrates a state in which the back cover member is cut along an opening assisting line portion arranged on the back cover member.

Furthermore, both the through-hole and the recessed portion 23*c* may be formed on the opening assisting line portion 23*b*. FIG. 11 is a cross-sectional view of the back cover member 202 according to such an embodiment, and illustrates a state in which aback cover member 202 is cut along an opening assisting line portion 223*b* formed on the back cover member 202. A plurality of through-holes 223*d* that pass through the back cover member 202 and that recess the surface of the back cover member 202 are formed on the opening assisting line portion 223*b* illustrated in FIG. 11. The through-hole 223*d* and the recessed portion 23*c* are aligned in the extending direction of the opening assisting line portion 223*b* so as to coexist at the opening assisting line portion 223*b*. In particular, the recessed portion 23*c* and the through-hole 223*d* are alternately aligned in the opening assisting line portion 223*b* illustrated in FIG. 11.

Figure 12:
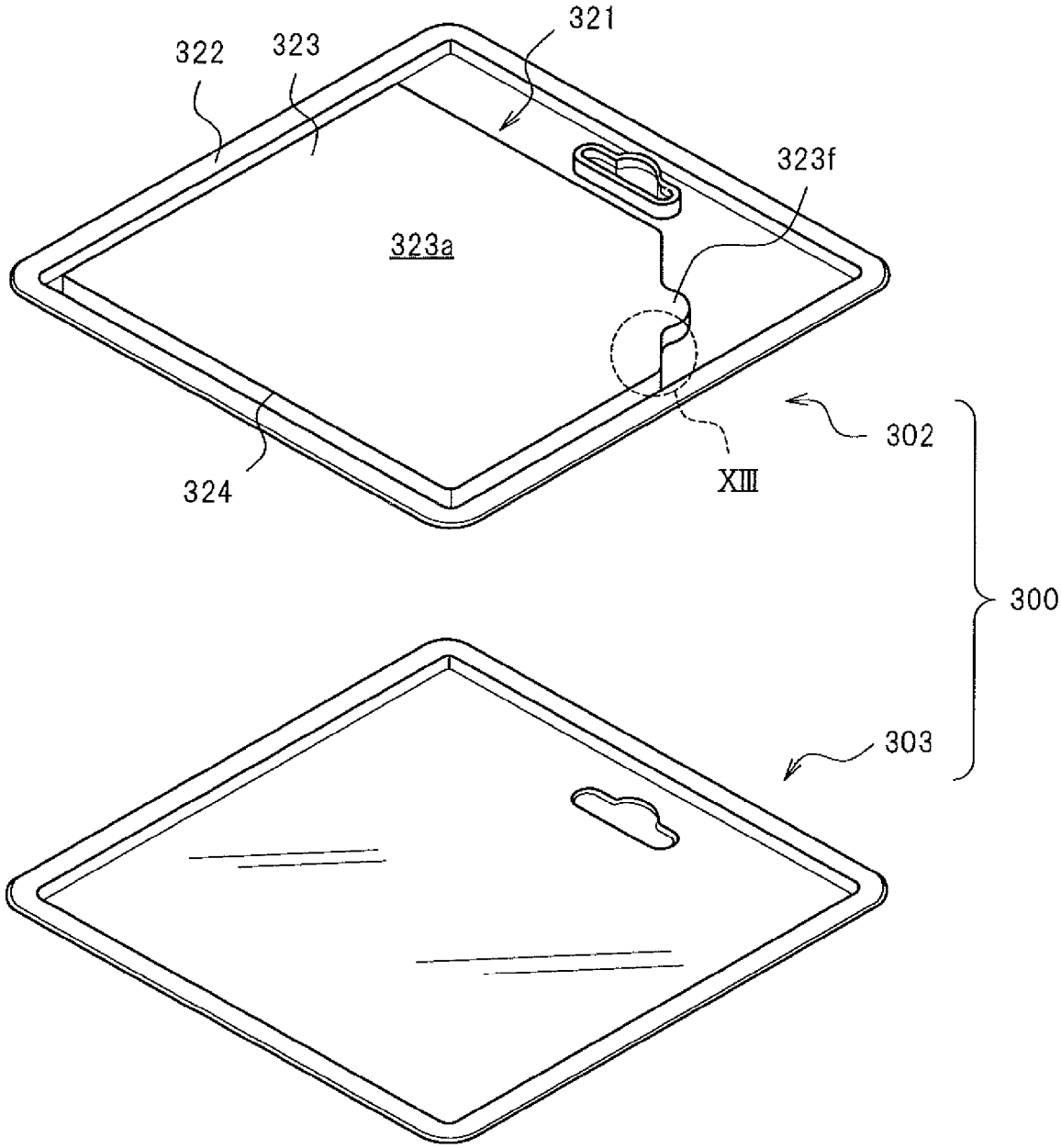
FIG. 12 is an exploded perspective view of a packaging container according to another embodiment of the present invention.

In the packaging container 1 described above, the accommodation recessed section 31 capable of accommodating articles is formed in the front cover member 3. However, the accommodation recessed section capable of accommodating articles may be formed in the back cover member 2, and the opening assisting line portion may be formed on the accommodation recessed section. FIG. 12 is an exploded perspective view of a packaging container 300 according to such an embodiment, and FIG. 13 is an enlarged view of a portion surrounded with a broken line XIII illustrated in FIG. 12.

As illustrated in FIG. 12, the packaging container 300 includes a back cover member 302 and a front cover member 303. The front cover member 303 is formed in a substantially plate shape, and the back cover member 302 includes an accommodation recessed section 321 capable of accommodating articles on the inner side of a square frame-shaped flange 322 provided at an outer peripheral edge of the back cover member 302. The accommodation recessed section 321 includes a plate-shaped back wall section 323 facing the front cover member 303. The back wall section 323 is formed so as to cover a housing space configured on the inner side of the accommodation recessed section 321 in a state where the back cover member 302 and the front cover member 303 are attached to each other. The accommodation recessed section 321 includes a side wall section 324 dropping from an outer peripheral edge 323*e* of the back wall section 323 towards the front cover member 3. The side wall section 324 surrounds the housing space in a state where the back cover member 302 and the front cover member 303 are attached to each other.

Figure 13:
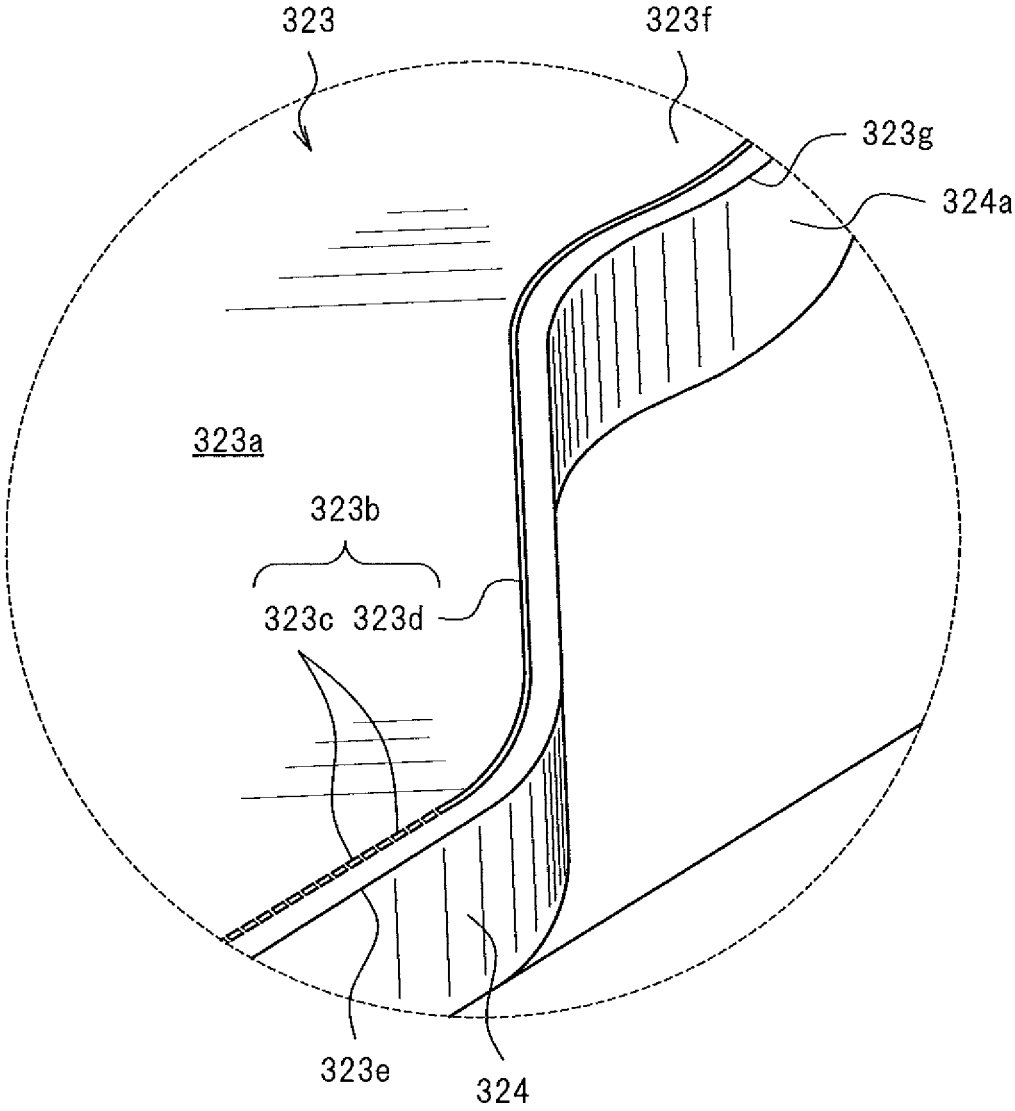
FIG. 13 is an enlarged view of a portion surrounded by a broken line XIII illustrated in FIG. 12.

As illustrated in FIG. 13, in the packaging container 300, an opening assisting line portion 323*b* is formed along the outer peripheral edge 323*e* of the back wall section 323 configuring the accommodation recessed section 321. An opening portion 323*a* surrounded by the opening assisting line portion 323*b* is provided on the inner side of the outer peripheral edge 323*e*. A plurality of recessed portions 323*c* aligned in a dotted line form are formed on the opening assisting line portion 323*b*, and the recessed portions 323*c* surround the opening portion 323*a*. In addition to the recessed portion 323*c* or in place of the recessed portion 323*c*, a through-hole may be formed on the opening assisting line portion 323*b*.

A protruding portion 323*f* that protrudes out towards the flange 322 is formed at the back wall section 323 (see FIG. 12). The side wall section 324 includes, at one part, a protruding wall portion 324*a* that drops from an edge 323*g* of the protruding portion 323*f*. A slit 323*d* that passes through the back cover member 302 is formed on the opening assisting line portion 23*b*, and the slit 323*d* is formed at the portion along the edge 323*g* of the protruding portion 323*f*. The slit 323*d* is curved along the edge 323*g*, and is close to the edge 323*g*. Thus, when a worker pushes the protruding wall portion 324*a* when opening the packaging container 300, the protruding wall portion 324*a* becomes hollow to the inner side, and hence the worker can pick a portion on the inner side of the slit 323*d* at the protruding portion 323*f*. When the worker pulls the protruding portion 323*f*, the opening assisting line portion 323*b* gradually tears to thereby open the opening portion 323*a*. A through-hole may be formed instead of the recessed portion 323*c* at the portion close to the slit 323*d* on the opening assisting line portion 323*b*. Thus, when the worker starts to pull the protruding portion 323*f*, the opening assisting line portion 323*b* easily tears to thereby further simplify the opening operation. The opening assisting line portion 323*b* is close to the outer peripheral edge 323*e* of the back wall section 323 and the edge 323*g* of the protruding portion 323*f*, and hence the opening portion 323*a* forms the major part of the back wall section 323. Thus, the worker can easily take out the articles placed inside the accommodation recessed section 321.

In the packaging container 1 described above, the opening assisting line portion 23*b* and the opening portion 23*a* surrounded by the opening assisting line portion 23*b* are formed on the back cover member 2. However, the opening assisting line portion and the opening portion may be formed at the front cover member 3.

What is claimed is:

1. A packaging container comprising:

a pair of cover members attached to each other to form a housing space for accommodating an article therein;

each cover member includes a peripheral portion, where the peripheral portion of each cover member engages one another, wherein:

at least one of the pair of cover members is integrally molded from a sheet-shaped plastic;

the at least one of the pair of cover members includes an opening portion at one part thereof facing the housing space, the opening portion being surrounded by an opening assisting line portion formed in a linear form and located radially inwardly from the peripheral portion, and being opened by tearing the opening assisting line portion when the packaging container is opened;

the opening assisting line portion has a plurality of recesses formed thereon and aligned in an extension direction of the opening assisting line portion, each of the plurality of recesses not piercing through the at least one of the pair of cover members and thereby forming a substantially flat bottom surface within each such recess.

2. A packaging container according to claim 1, wherein:

the opening assisting line portion further includes a plurality of holes passing through the at least one of the pair of cover members; and the plurality of the recessed portions and the plurality of holes are aligned in the extending direction of the opening assisting line portion so as to coexist on the opening assisting line portion.

3. A packaging container according to claim 1, wherein an interval between an adjacent two of the plurality of the recessed portions is smaller than a thickness of the at least one of the pair of cover members.

4. A packaging container according to claim 1, wherein:

the at least one of the pair of cover members is formed with an opening; and the opening assisting line portion extends from an edge of the opening and surrounds the opening portion.

5. A packaging container according to claim 4 wherein the opening assisting line portion is formed with a slit formed at an end thereof, the slit continuing to the opening.

6. A packaging container according to claim 1, wherein:

the packaging container comprises a panel that can be curved and the panel is placed along the opening portion at an inner side of the packaging container; and the panel is larger than the opening portion and is placed so that an outer peripheral edge thereof extends along the opening assisting line portion.

* * * * *